US005316800A

United States Patent [19]

Noakes et al.

[11] Patent Number: 5,316,800

[45] Date of Patent: May 31, 1994

[54] SPRAYING OF LIQUIDS

[75] Inventors: Timothey J. Noakes, Clwyd; Ian D. Pavey, Sussex; Christopher S. Jeffs, Reading, all of England

[73] Assignee: Imperial Chemical Industries PLC, London, England

[21] Appl. No.: 742,741

[22] Filed: Aug. 9, 1991

[30] Foreign Application Priority Data

Aug. 9, 1990 [GB] United Kingdom ..... 9017476
Aug. 9, 1990 [GB] United Kingdom ..... 9017477
Aug. 9, 1990 [GB] United Kingdom ..... 9017478

[51] Int. Cl.[5] ..... B05D 1/06

[52] U.S. Cl. ..... 427/466; 427/256; 427/288; 427/469; 427/477; 427/479; 427/482; 427/485; 118/624; 118/626; 118/628; 118/640; 239/3

[58] Field of Search ..... 427/13, 14.1, 30, 31, 427/33, 288, 256, 458, 466, 469, 477, 478, 481, 482, 479, 483, 485; 239/3; 118/626, 624, 628, 640

[56] References Cited

U.S. PATENT DOCUMENTS 4,749,125 6/1988 Escallon et al. ..... 239/3
4,841,307 6/1989 Graham ..... 118/325 X
4,925,708 5/1990 Waters et al. ..... 427/13 X

*Primary Examiner*—Janyce Bell
*Attorney, Agent, or Firm*—Cushman, Darby & Cushman

[57] ABSTRACT

A coating is applied to a substrate by conveying the substrate past a number of liquid spraying nozzles (32) to which high voltage is applied to produce spray in the form of liquid ligaments which deposit as such, or in the form of droplets, on the substrate to form generally parallel tracks which merge with each other to produce a substantially uniform thickness coating. The nozzles (32) are operable in two modes: a normal spraying mode and a deflect mode in which the ligaments are deflected away from the substrate and towards a collector electrode (34). Operation of the nozzles (32) may be coordinated so that different formulations are deposited as separate panels in succession lengthwise of the substrate. The coating system is particularly suitable for coating multicoloured dyesheets for use in thermal transfer printing.

32 Claims, 7 Drawing Sheets

SPRAYING OF LIQUIDS

This invention relates to the coating of substrates.

According to one aspect of the present invention there is provided a method of coating a substrate, said method comprising:

supplying an extended nozzle with liquid to form a continuous film of liquid lengthwise of the extended nozzle;

moving the substrate and the nozzle relative to one another in a direction other than parallel to the direction of nozzle extension;

generating from the nozzle, by means of the application of a high electrical potential, a plurality of generally parallel ligaments of liquid which are simultaneously drawn out from the nozzle by preponderantly electrostatic forces; and directing the ligaments towards the substrate so that the ligaments deposit on the substrate as generally parallel ligaments and/or in the form of generally parallel streams of droplets (derived from breaking up of the ligaments) and thereafter merge to form a coating on the substrate surface.

Preferably the ligaments are deposited on the substrate before they break up into droplets.

Preferably, deposition of the ligaments and/or droplets on the substrate is interrupted periodically to produce a series of coated sections on the substrate which are spaced apart in the direction of relative movement.

According to a second aspect of the invention there is provided apparatus for coating a substrate, said apparatus comprising:

an extended nozzle;

means for supplying liquid to the nozzle so that, in use, a continuous film of liquid is formed lengthwise of the extended nozzle;

means for effecting relative movement between the nozzle and a substrate to be coated in a direction which is other than parallel to the direction of nozzle extension;

high voltage circuit means for simultaneously drawing out, by preponderantly electrostatic forces, a plurality of generally parallel ligaments of liquid from said continuous liquid film; and means locating the nozzle relative to the substrate in such a way that the ligaments deposit on the substrate as generally parallel ligaments and/or in the form of generally parallel streams of droplets (derived from breaking up of the ligaments) and thereafter merge to form a coating on the substrate surface.

Preferably means is provided for periodically interrupting deposition of said ligaments and/or droplets on the substrate to produce a series of coated sections on the substrate which are spaced apart in the direction of relative movement.

A feature of the invention is that the electrically charged ligaments and/or droplets are deposited as substantially parallel ligaments or substantially parallel streams of droplets. To achieve this, it is necessary to locate the nozzle sufficiently close to the substrate that the ligaments deposit as such or, if they break up into droplets, the droplets deposit on the substrate before the mutual repulsion forces acting between each droplet and its neighbours cause the droplets derived from each ligament to diverge without depositing as a stream or track parallel to streams or tracks formed from the droplets derived from other ligaments produced by the nozzle. By depositing the ligaments or droplets in this manner, it is possible to achieve sharp cut-off of each coated section.

Although deposition of the ligaments or droplets in this manner would appear to be disadvantageous from the standpoint of producing substantially uniform thickness coatings, surprisingly we have found that, despite the fact that the ligaments issuing from the nozzle may for example be of the order of 50 microns in diameter and issue at a pitch (lengthwise of the nozzle) of the order of 500 to 700 microns, the deposited parallel ligaments or streams of droplets can merge to form a substantially uniform thickness coating by having regard to factors such as:

(a) the interfacial properties, e.g. surface tension, existing between the substrate and the liquid;

(b) the rate of deposition of the liquid per unit area which, in turn, is related to the speed of travel of the substrate relative to the nozzle;

(c) the viscosity of the liquid which, in turn, may be dependent on temperature and the rate of evaporation of any solvent present in the liquid; and (d) the direction of gravity relative to the direction of substrate travel ( we have found that the substrate should desirably have a substantial component of vertical extension in the region of the coating position, particularly immediately after deposition).

It is known from U.S. Pat. No. 4,749,125 to generate ligaments of liquid electrostatically and direct the ligaments towards a surface and reference is made to the formation of synthetic fiber and to the lubrication of a substrate using fine ligaments of oil. There is no reference therein to depositing the ligaments or droplets so as to form generally parallel ligaments or streams of droplets which thereafter merge nor is there any reference to deposition so as to form spaced sections of coated substrate.

Preferably the generation of the ligaments is such that the liquid flow rate associated with each ligament is substantially constant for substantially all of the ligaments. We have found that the production of a substantially uniform thickness coating is promoted if at any instant the liquid flow rate associated with the initially formed ligaments is substantially the same for substantially all of the ligaments so that the quantity of liquid deposited on the substrate per unit length of the deposited ligament or droplet stream is substantially the same for substantially all ligaments/streams. Substantially the same liquid flow rate for each of the ligaments can be achieved by avoiding significant variation in the flow rate of the liquid in the vicinity of the region of ligament formation at the nozzle. By substantially the same, we mean that the quantity of liquid deposited per unit length for each ligament/stream is within 10% of the average quantity deposited per unit length for all the ligaments/streams.

U.S. Pat. No. 4,749,125 discloses nozzle designs which are such that the liquid flow rates associated with the ligaments produced will inevitably differ significantly at different positions along the slot of the nozzle. For instance, the nozzle design illustrated in FIGS. 1 to 4 uses a shim which defines the width of the slot and precision chamber openings, the shim comprising a discontinuous edge with crests having rounded ends so as not to concentrate charge at the shim edge (Column 5, lines 16 to 18). Such shims will result in the ligaments produced by the nozzle having varying liquid flow rates, i.e. ligaments formed at positions corresponding to the rounded peaks of the shim edge will tend to have flow rates which are substantially less than ligaments forming at positions corresponding to the valleys in the shim edge. This is because the liquid will tend to separate from the shim and create dead spots in the vicinity of the rounded crests.

Preferably, the direction of relative movement between the nozzle and the substrate is generally perpendicular to the direction of nozzle extension.

As previously mentioned, it is preferred that the ligaments deposit as such on the substrate rather than break up into droplets; this may be ensured by control of the electric field strength together with control of the flowrate of liquid to the nozzle and by selection of the viscosity of the liquid.

Preferably the deposition of the ligaments on the substrate is periodically interrupted (not necessarily at regular intervals) without interrupting supply of liquid to the nozzle.

In one embodiment of the invention, this is achieved by temporarily modifying the applied electrical potential to cause ligament generation to cease. For example, the application of the high potential may be interrupted, or its magnitude reduced substantially, for a short interval of time. The time interval can for instance be made sufficiently brief (e.g. of the order of a few milliseconds) that a small gap is produced in deposition of liquid on to the substrate of a dimension such that successive areas of deposited liquid cannot merge thereby producing mutually distinct areas of deposition. This aspect of the invention has applications in the production of markings such as bar codes. The time interval of interruption may be variable so that the spacing between the mutually distinct areas of deposition can be made different according to requirements.

In an alternative and presently preferred embodiment of the invention, the periodic interruption is effected by interrupting spraying of the liquid on to the substrate by deflecting the spray away from the substrate and towards auxiliary target means.

Preferably spraying of the liquid from the nozzle is continued throughout operation in the deflection mode so that problems can be avoided in stopping and resuming supply of liquid to the nozzle. However, where time permits, we do not exclude the possibility of deflecting the spray towards the auxiliary target means, temporarily discontinuing the spray, thereafter resuming spraying while still operating in the deflection mode until normal spraying conditions are achieved and then reverting to conditions in which the spray is deposited on to the substrate.

For example, the spray may be temporarily quenched after operation in the deflection mode has commenced by adjusting the electrical field strength in the vicinity of the nozzle without interrupting supply of the liquid to the nozzle. In conventional operation, the liquid build up that occurs at the nozzle would tend to give rise to undesirable spurting of the spray when the field strength is re-adjusted to resume spraying; however, if spraying is resumed while operating in the deflection mode, any spurting is directed towards the auxiliary target means rather than the substrate. Thus, in this instance, if timing permits spraying can be temporarily quenched during operation in the deflection mode and resumed sufficiently in advance of reverting to spraying on to the substrate that spurting and any other undesirable spraying effects can be eliminated.

Preferably during operation in the deflection mode, liquid accumulating on the auxiliary target means is removed.

According to a preferred aspect of the present invention there is provided a method of coating a substrate, said method comprising:

supplying an extended nozzle with liquid to form a continuous film of liquid lengthwise of the extended nozzle;

moving the substrate and the nozzle relative to one another in a direction other than parallel to the direction of nozzle extension;

generating from the nozzle, by means of the application of a high electrical potential, a plurality of generally parallel ligaments of liquid which are simultaneously drawn out from the nozzle by preponderantly electrostatic forces;

directing the ligaments towards the substrate so that the ligaments deposit on the substrate in discrete zones as generally parallel ligaments and/or in the form of generally parallel streams of droplets (derived from breaking up of the ligaments) and thereafter merge to form a coating on the substrate surface;

interrupting deposition of said ligaments/droplets on to the substrate by deflecting the ligaments away from the substrate and towards auxiliary target means; and resuming coating of the substrate with liquid from the nozzle.

Advantageously, liquid accumulating on the auxiliary target means is removed from the target means while continuing generation of said liquid ligaments from the nozzle.

According to another preferred aspect of the present invention there is provided apparatus for coating a substrate, said apparatus comprising:

an extended nozzle;

means for supplying the extended nozzle with liquid to form a continuous film of liquid lengthwise of the extended nozzle;

means for moving the substrate and the nozzle relative to one another in a direction other than parallel to the direction of nozzle extension;

high voltage means for generating from the nozzle a plurality of generally parallel ligaments of liquid which are simultaneously drawn out from the nozzle by preponderantly electrostatic forces and are directed towards the substrate so that the ligaments deposit on the substrate in discrete zones as generally parallel ligaments and/or in the form of generally parallel streams of droplets (derived from breaking up of the ligaments) and thereafter merge to form a coating on the substrate surface;

auxiliary target means; and means operable periodically to deflect the ligaments away from the substrate and towards the auxiliary target means and thereby interrupt deposition of said ligaments/droplets on to the substrate.

Preferably the apparatus includes means for removing liquid accumulating on the auxiliary target means while continuing generation of said. liquid ligaments from the nozzle.

By removing the liquid collecting on the auxiliary target means, the possibility is avoided of liquid from the auxiliary target means being drawn away from the latter by the electrostatic field and towards the nozzle causing disruption of the spray.

In those aspects of the invention involving deflection of the spray towards an auxiliary target means, if the substrate continues to move relative to the nozzle during said interruption, then the extent of the spacing between successive coated areas can be controlled for example by varying the interval of time during which the spray is interrupted as aforesaid or by controlling the spraying in accordance with registration marks which may be provided on the substrate, such registration marks indicating for instance the starting and/or end points on the substrate at which coating is to begin or end.

Preferably said interruption is effected by generating an electric field which is effective to deflect the ligaments away from the substrate.

Usually, the relative movement between the nozzle and the substrate will be continuous, as opposed to intermittent and, in particular, the relative movement will continue throughout the time that the nozzle is operable to deposit ligaments/droplets on the substrate and also throughout the operation in the deflection mode.

Typically the substrate will be of an electrically insulating material; it is advantageous therefore to locate the substrate between the nozzle and a conductor which may be earthed or at a potential with respect to the nozzle such that the charged liquid ligaments/droplets are attracted by the conductor towards the intervening substrate. If the substrate is a highly insulating material, as will often be the case, together with the deposited charged coating material and the conductor, it will form a large capacitance (with the substrate acting as the dielectric and assuming that the substrate is of a suitable thickness) and thereby prevent the build-up of a significant potential which would otherwise tend to repel the spray directed towards the substrate.

The conductor may for example be constituted by a metal roller over which the substrate passes as it is fed along a predetermined path. The feed path may traverse a number of spraying stations at each of which it passes a nozzle and conductor arrangement as described above.

Where the substrate is of an electrically insulating material, instead of providing a conductor at the opposite side of the web to the nozzle, means may be provided for electrically charging the face of the substrate remote from the nozzle with a charge opposite to that borne by the liquid sprayed from the nozzle. For example, an electrically charged liquid spray may be directed on to said remote face of the substrate such that the charge is of opposite polarity to that borne by the liquid sprayed on to the other face of the substrate. The liquid sprayed on to said remote face may be one which can be readily removed during further processing of the substrate or it may be one which forms a permanent coating on said remote face. The liquid sprayed on to said remote face may be deposited from a nozzle arrangement in a similar manner to that used for deposition of the liquid on the other side of the substrate.

Instead of spraying a charged liquid on to said remote face of the substrate, the latter face may be sprayed with electrical charge of the appropriate polarity generated for instance by means of corona discharge, e.g. from a carbon brush electrode.

The auxiliary target means is conveniently in the form, of a roller and the means for removing liquid collecting on the auxiliary target means may comprise a scraper or doctor blade which may be arranged to deflect the liquid into a reservoir for recycling to the nozzle.

When the auxiliary target means is not operable to deflect the spray away from the substrate, it may have a potential applied thereto which, in relation to that existing at or in the vicinity of the substrate, favours attraction of the charged liquid ligaments and/or droplets towards the substrate.

On the other hand, when the auxiliary target means is required to deflect the spray away from the substrate, the potentials applied to the auxiliary target means and at or in the region of the substrate are preferably such that attraction of the liquid ligaments/droplets towards the auxiliary target means is favoured.

For example, when the auxiliary target means is not intended to operate in its deflecting mode, it may have a potential which is of the same polarity as the nozzle while the potential in the immediate vicinity of the substrate may be of the opposite polarity; on the other hand, when the auxiliary target means is required to operate in its deflecting mode, it may have a potential which relative to the nozzle potential and that applied in the immediate vicinity of the substrate strongly favours attraction of the spray towards the auxiliary target means and hence away from the substrate. In both instances, the potentials applied to the auxiliary target means and at or in the vicinity of the substrate may be of substantially the same magnitude but of opposite polarity.

In some circumstances, at the time the auxiliary target means is switched between its operative (deflecting) and inoperative (non-deflecting) modes, it may be advantageous if the electric field or fields existing between the nozzle, the substrate and the auxiliary target means are momentarily reduced in strength to a substantial extent or switched off altogether so as to temporarily cease electrostatic spraying and thereby eliminate uncertainty in the direction of spraying during the switch-over period. In practice, electrostatic spraying may be discontinued for only a very short time interval, for example less than 10 milliseconds.

Advantageously selectively operable means is provided for controlling the duration of said interruption.

In some embodiments of the invention as defined in any of the above aspects, there may be two or more nozzles arranged to direct respective sprays towards the substrate, the arrangement being such that each nozzle produces a series of spaced apart coated areas interleaved with the coated areas produced by the other nozzle or nozzles.

According to this aspect of the present invention there is provided a method of coating a substrate, comprising:

supplying a group comprising at least two extended nozzles with liquid to form a continuous film of liquid lengthwise of the each extended nozzle;

effecting relative movement between the substrate and the nozzles in a direction other than parallel to the direction of nozzle extension;

generating from each nozzle, by means of the application of a high electrical potential, a plurality of generally parallel ligaments of liquid which are simultaneously drawn out from the nozzle by preponderantly electrostatic forces; and directing the ligaments from each nozzle towards the substrate so that the ligaments from each nozzle deposit on substantially the same section of the substrate as ligaments and/or in the form of droplets (derived from breaking up of the ligaments) and thereafter merge to form a coating on that section of the substrate surface.

Also according to this aspect of the invention there is provided apparatus for coating a substrate, said apparatus comprising:

a group of at least two extended nozzles;

means for supplying liquid to the nozzles so that, in use, a continuous film of liquid is formed lengthwise of each extended nozzle;

means for effecting relative movement between the nozzles and a substrate to be coated in a direction which is other than parallel to the direction of nozzle extension;

high voltage circuit means associated with each nozzle for simultaneously drawing out, by preponderantly electrostatic forces, a plurality of generally parallel ligaments of liquid from said continuous liquid film; and means locating the nozzles relative to the substrate in such a way that the ligaments from each nozzle deposit on substantially the same section of the substrate as such and/or in the form of droplets (derived from breaking up of the ligaments) and thereafter merge to form a coating on that section of the substrate surface.

The nozzles are conveniently disposed in generally parallel relation with each other and the direction of relative movement between the nozzles and the substrate is preferably generally perpendicular to the direction of nozzle extension.

Preferably the ligaments and/or droplets are deposited on the substrate so that they merge and form a substantially uniform thickness coating.

The nozzles may be supplied with liquids having substantially the same composition or they may be supplied with liquids having different compositions. For example, the liquids may have compositions such that they chemically react with each other when combined as a result of deposition on the substrate.

Usually the nozzles are spaced apart in the direction of movement of the substrate and means may be provided for operating the nozzles in sequence whereby one nozzle deposits ligaments and/or droplets on to a section of the substrate and, after the substrate has travelled a predetermined distance, the other or next nozzle deposits ligaments and/or droplets on to the same section of the substrate.

Each nozzle may have a toothed discharge edge defining a plurality of ligament formation sites and the nozzles may be arranged with the teeth thereof disposed so that the ligaments and/or droplets deposited by each nozzle are interleaved with those deposited by the other nozzle or nozzles of the group.

Preferably there are at least two groups of nozzles each arranged as aforesaid, the arrangement being such that each group deposits ligaments and/or droplets on to different sections of the substrate.

Desirably the generation of the ligaments by each nozzle is such that the liquid flow rate associated with each ligament is substantially the same for substantially all of the ligaments generated by that nozzle and by the nozzles in the group.

The extended nozzle referred to in any of the above aspects of the invention is preferably of rectilinear configuration; we do not however, exclude nozzles of other configuration such as curvilinear or annular configuration.

Although not restricted to any specific application, the present invention in at least some aspects thereof is particularly suitable for coating substrates with mutually distinct areas of coating material especially where adjacent coated areas are required to have different characteristics. For example, the invention has application to the manufacture of dyesheets such as are used in the production of multi-coloured images by dye diffusion thermal transfer printing.

Dye diffusion thermal transfer printing is a process in which thermally transferable dyes are caused to transfer from selected areas of a dyesheet to a receiver sheet held against it, by application of heat to those selected areas. Dyesheets generally consist essentially of a thin sheet-like substrate, supporting on one surface (its obverse surface) a transfer coat comprising a thermally transferable dye, usually held in a polymeric binder. Additional coatings may also be present, including for example adhesive subbing layers between substrate and transfer coat, and backcoats on the other (reverse) surface of the substrate for improving slip or heat resistant properties.

Printing is effected by heating selected discrete areas of the dyesheet while its transfer coat is pressed against a receiver surface of dye-receptive material, thereby causing dye to diffuse from the transfer coat into the corresponding areas of the dye-receptive surface. The heat for transferring the dyes can be supplied by printers having thermal printing heads which are pressed against the reverse surface of the dyesheet (or any overlying backcoat). Thermal printing heads have rows of tiny heaters, typically six or more to the millimeter, and these are selectively actuated intermittently according to electronic pattern-information signals received by the printer, to give individual pixels of the required print, the pattern so formed by these pixels thus being in accordance with the pattern-information signals. The electronic signal may be from a video, electronic still camera or computer, for example. The dyesheet may be elongated in the form of a ribbon and housed in a cassette for convenience, enabling it to be wound on to expose fresh areas of the transfer coat after each print has been made.

Dyesheets designed for producing multicolour prints have a plurality of panels of different uniform colours, usually three: yellow, magenta and cyan, although the provision of a fourth panel containing a black dye, has also previously been suggested. When supported on a substrate elongated in the form of a ribbon, these different panels are usually in the form of transverse panels, each the size of the desired print, arranged in a repeated sequence of the colours used. During printing, panels of each colour in turn are pressed against the dye-receptive surface of the receiver sheet, as the two sheets are passed together across the printing head to transfer the dye selectively where required, this colour being overprinted by each subsequent colour to make up the full colour image. To enable prints to be made in this manner, the colours are provided by dyes which can diffuse through the binder and into the receiver sheet when heated.

One known method of producing such dyesheets is by gravure roller printing techniques. This has the disadvantage that when changes in the format of the dyesheet are required, for example variation in the width dimension (lengthwise of the direction of elongation of the substrate) of the colour panels, considerable downtimes are involved in adapting the gravure roller equipment to the new format. With the apparatus and method of the present invention, format changes can be made rapidly since the width dimensions of the colour panels can be readily controlled by varying the nozzle spraying duration (i.e. the time during which the nozzle is operational to deposit the ligaments/droplets on to the substrate) and/or varying the relative speed between the substrate and the nozzle. Thus, apparatus in accordance with the invention may be controlled by means of a computer so that format changes can be made virtually without interrupting the coating process.

According to a further aspect of the present invention there is provided a substrate which has been coated by the method defined in accordance with any one of the aspects of the invention specified above.

BRIEF DESCRIPTION OF THE DRAWINGS

The invention will now be described by way of example only with reference to the accompanying drawings in which:

Referring to FIG. 1, a typical application of the present invention is in the production of dyesheets which involves the coating of a thin flexible substrate 10 with different dye-binder formulations to produce a series of differently coloured panels A, B, C, D interleaved in the manner indicated in FIG. 1. Thus, for example, panels A, B, C and D may be yellow, magenta, cyan and black respectively.

Figure 1:
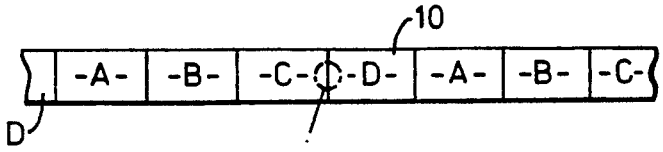
FIG. 1 shows the layout of a dyesheet for use in thermal transfer printing including an enlarged fragmentary view (FIG. 1A) illustrating a panel edge feature resulting from the manner in which the coatings are applied in the embodiments described below.
Figure 2:
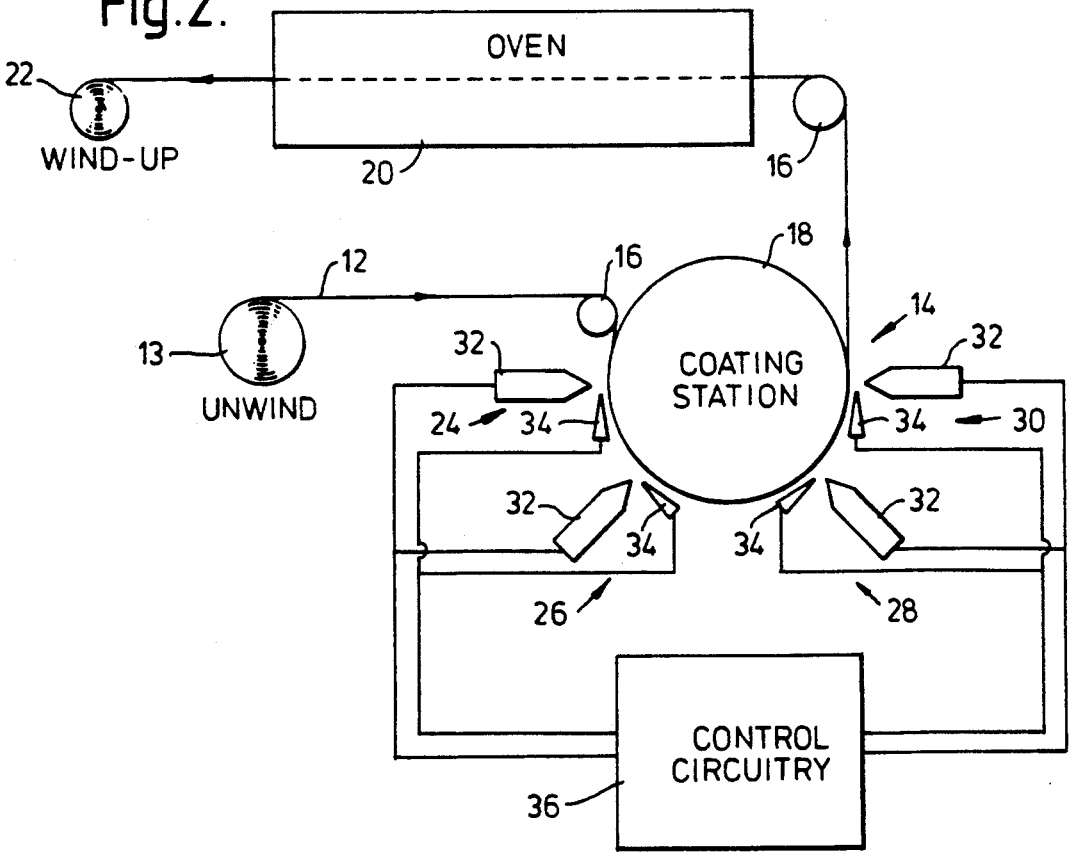
FIG. 2 is a diagrammatic view of a first embodiment of apparatus for coating a continuous web with panels of different coloured dyes to produce a dyesheet of the form shown in FIG. 1.

As shown schematically in FIG. 2, the dyesheet is produced by continuously feeding a web 12 of the substrate material from a storage roll 13 through a coating station 14, the web being directed by guide rollers 16 and entrained around a large driven roller 18 before being fed through a drying/curing oven 20 and wound onto a driven wind-up roller 22. Each of the different coating formulations is applied to the web at successive locations around the periphery of the roller 18 by means of respective applicator assemblies 24–30, there being four such assemblies when the web 12 is intended to be coated with four differently coloured panels as in FIG. 1.

Each applicator assembly comprises a linear nozzle 32 and an auxiliary or recycle electrode 34 arranged in close proximity to one another and to the periphery of the roller 18. Each applicator assembly 24 -30 is controlled by means of computer-based control circuitry 36 in such a way that each nozzle 32 discharges the respective coating formulation onto the web 12 while the latter is in motion for a predetermined interval of time and in a sequence such that the nozzles produce on the web the series of panels A–D, each panel extending across the full width of the web, being of a desired length in the direction of web feed and having its edges immediately next to those of the panels on either side thereof. Typically, the spacing between the edges of successive panels will be of the order of 1 mm or less.

Figure 3:
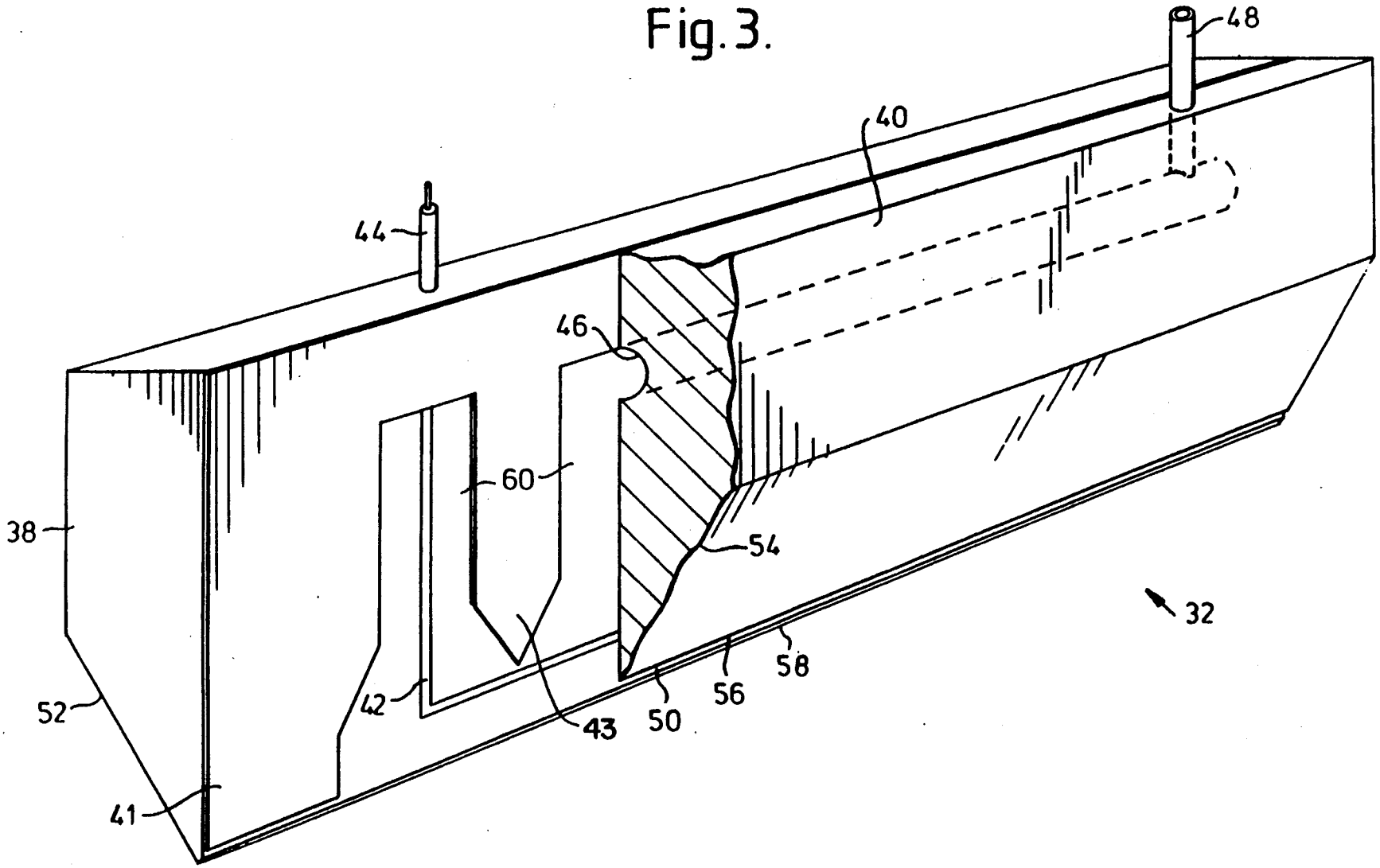
FIG. 3 is a perspective view, partly cut away, showing a typical nozzle design for use in the apparatus of FIG. 2.

Each nozzle 32 is of the electrostatic type having an extended configuration of the form disclosed in for example FIGS. 12 to 14 of our prior British Patent No. 1569707. The nozzle may have a field adjusting electrode associated therewith as disclosed in Patent No. 1569707 but this is not essential. FIG. 3 illustrates one form of nozzle suitable for use in the apparatus of FIG. 2. As shown in FIG. 3, the nozzle 32 comprises a pair of body parts 38, 40 of insulating material (or possibly semi-conducting or semi-insulating material) secured together by unshown means with a thin gasket 41 between them in order to space the parts 38, 40 from one another. One part 38 is formed with a recess which receives a semi-conducting or conducting material to form a continuous track 42 which can be connected to an HT supply by means of terminal 44. The other part 40 is formed with a gallery 46 running lengthwise of the nozzle and connected to an inlet 48 for connection to a supply of the liquid coating material to be applied to the web 12.

The spacing created between the parts 38, 40 by the gasket 41 serves to provide a linear slot 50 and the parts 38, 40 are bevelled at 52, 54 in the region of the slot 50 to provide relatively sharp edges in that region. It will be noted that the part 38 projects slightly beyond the part 40 in the vicinity of the slot 50 and thereby provides a ledge 56 which is also bevelled at 58. The nozzle 32 is so dimensioned that the length of the slot 50 substantially spans the width of the web 12 (in practice, it may be slightly less than the web width).

The coating formulation is supplied to the slot 50 via the gallery 46 and a series of channels 60 which are formed by cut-outs in the gasket 41 and serve to distribute the liquid evenly over the length of the nozzle, the gasket being so shaped that the flow channels 60 merge in advance of the slot 50 and in advance of a portion of the track 42 which runs generally parallel to the slot 50. Thus, as liquid flows towards the slot 50 from the channels 60, the liquid merges to form a continuous film along the slot 50 and in contact with the track 42 so that the liquid becomes charged when the HT supply is connected to the terminal 44. It will be seen that the gasket 41 is generally comb-shaped and has a series of legs 43 between which the channels 60 are defined. Each leg 43 terminates in an end portion which has a contour such that the liquid flowing in each channel 60 does not tend to separate from the edges of the legs. For example, if the legs 43 terminated in a flat or blunt rounded end, the liquid would tend to separate from the edges of the legs and thereby create a "dead spot" in the vicinity of the nozzle slot.

In normal operation of the nozzle 32, the liquid is subjected to an intense electrostatic field as it emerges from the slot 50 and travels across the ledge 56 and, as a consequence, the liquid is drawn out into a series of substantially equispaced ligaments as it leaves the bevelled edge 58 and the ligaments travel in the direction of the axis of the nozzle, i.e. generally perpendicular to the direction of slot extension and in a plane generally coplanar with the gasket 41. Depending on the distance between the nozzle and the intended target means to be coated, the ligaments may remain intact and deposit as such on to the target means or they may break up or atomise into droplets before depositing on to the target means. If desired, the ledge 56 may be formed with equispaced teeth in the manner described in our prior European Patent No. 243031 in order to provide well-defined sites for ligament formation. In many applications however, satisfactory ligament formation can be obtained without the need for the provision of a toothed nozzle. Toothed nozzles may be advantageous in situations where more than one nozzle is used to spray each colour panel, as described hereinafter.

Because the liquid is supplied to the nozzle slot without creating "dead spots", the ligaments drawn out by the electric field are substantially uniform in that the liquid flow rate associated with each ligament is substantially the same as that associated with all of the other ligaments. This is of importance in securing a coating of substantially uniform thickness.

Figure 4:
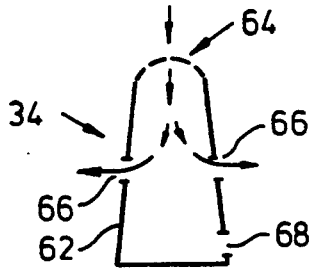
FIG. 4 is a diagrammatic view in section of a recycle or auxiliary electrode as used in the apparatus of FIG. 2.

In the embodiment of FIG. 2, each auxiliary electrode 34 is in the form of a receptacle 62 (FIG. 4) which in part is apertured or is of a permeable or porous nature to provide an inlet area 64 spanning at least the width of the web 12 The inlet area 64 may for example be formed by a piece of gauze material or the like spanning a slot opening in the receptacle, the slot dimension being at least co-extensive with the width of the web 12. Means (not shown) is provided to create a partial vacuum within the receptacle 62 or induce a flow of air through the receptacle (e.g. from the inlet area 64 to air outlets 66 as depicted by arrows in FIG. 4) so as to draw any liquid depositing on the inlet area 64 into the interior of the receptacle and thereby remove the liquid from the inlet area. Liquid collecting in the receptacle 62 may be recycled via liquid outlet 68 back to the associated nozzle, e.g. via a reservoir for supplying the liquid to the nozzle. The receptacle 62 comprises at least in part, or is provided with, an electrical conducting material so that an electrical potential can be applied to the inlet area 64 for the purposes described hereinafter. For example, where the inlet area 64 is formed by a slot covered by gauze, the receptacle may be of an insulating material and the gauze may be an electrical conductor.

The control circuitry 36 is arranged to control each nozzle and the associated auxiliary electrode in such a way that the liquid ligaments issuing from the nozzle deposit (as such or as droplets or possibly a combination of both) either on the web or on the auxiliary electrode depending on whether the particular section of web 12 traversing that nozzle requires the corresponding coating formulation to be applied. The nozzles 32 are oriented so that the ligaments, when not influenced by the auxiliary electrode, travel generally radially with respect to the axis of the roller 18 and hence generally normal to the plane of the web at the point of impact of the ligaments (or droplets) on the web. It will be noted that the locations at which each nozzle 32 projects ligaments towards the roller 18 are such that the direction of web travel immediately after the point of coating has a significant vertical component. This has been found to be advantageous in terms of securing uniform thickness coatings; if the web motion is predominantly horizontal immediately after the coating position and if the coated surface is inverted, there appears to be a tendency for the coating to be uneven apparently because of the effects of gravity.

The roller 18 is connected to earth so that it acts as a counter electrode and is attractive with respect to the charged ligaments.

Figure 5:
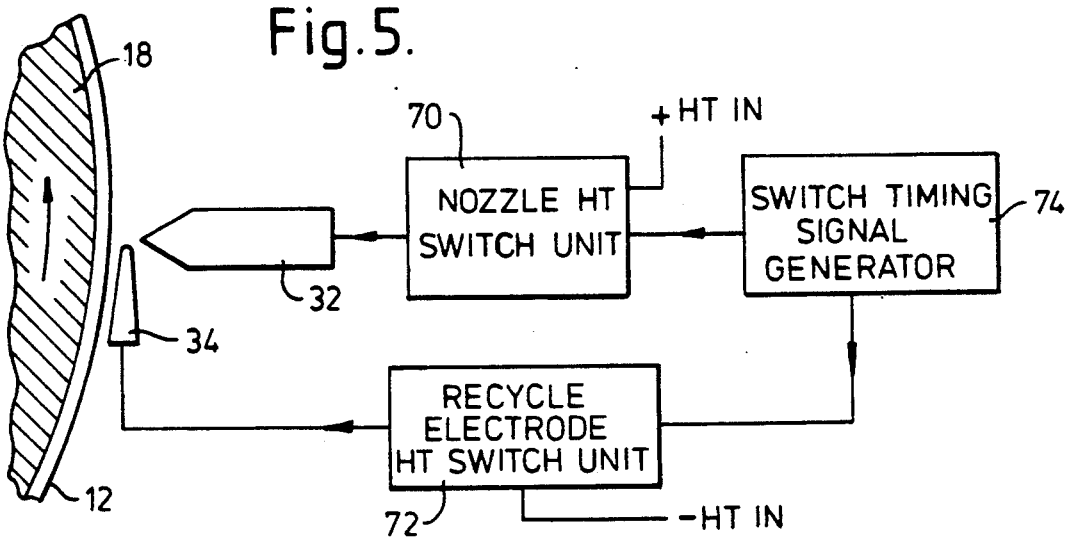
FIG. 5 is a view in block diagrammatic form the electrical circuitry for controlling the nozzles of the apparatus in FIG. 2.

That part of the control circuitry relevant to each nozzle/auxiliary electrode assembly is shown in more detail in FIG. 5. The control circuitry 36 includes an HT generator from which high voltages of opposite polarity can be derived, e.g. +20 kV and −10 kV. The application of these voltages to the nozzle and auxiliary electrode is controlled by respective switching units 70 and 72 which, in turn, are controlled by a switch timing signal generator 74. The timing signal generator 74 forms part of a microprocessor or computer which is programmed with data representing the particular format (e.g. panel dimensions and colour sequence) for the web to be coated and with data representing the positioning of the coating applicators 24–30 and web speed so that coating effected by the applicators is coordinated with the web speed and meets the format requirements for that particular web.

Figure 6:
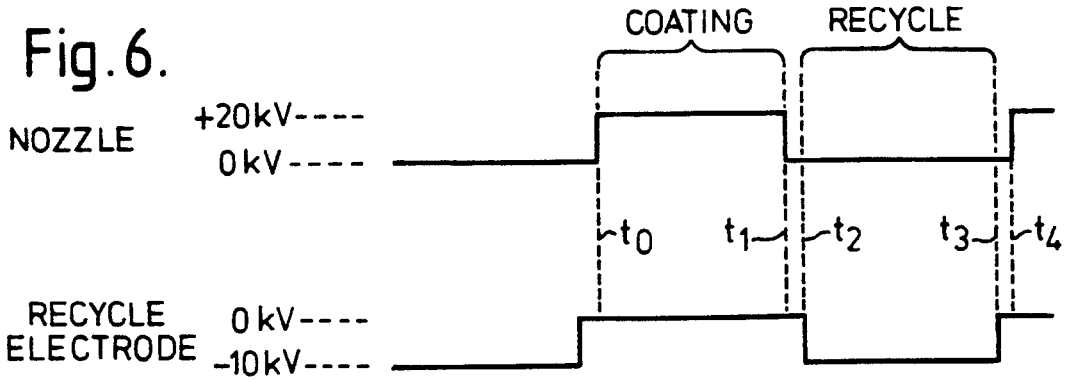
FIG. 6 is a timing diagram illustrating the sequence in which voltage changes are applied to each nozzle and recycle electrode set in the embodiment of FIG. 2.

The operating sequence of the circuitry shown in FIG. 5 is best understood by reference to the timing diagram of FIG. 6 and the diagrams of FIGS. 7A to 7E. For each coating applicator, each cycle may be considered to commence with the application of sufficient voltage to the nozzle 32 to produce ligament formation This point in the cycle corresponds to the point $t_0$ in FIG. 6. At this time, a high voltage (e.g. +20 kV) is coupled to the nozzle 32 via the switch unit 70 under the control of the signal generator 74 while the auxiliary electrode 34 is coupled to a low voltage (e.g. 0 kV or earth) via switch unit 72 under the control of generator 74. The liquid, which is supplied to the nozzle continuously throughout the cycle, is caused to issue from the nozzle ledge 56 as ligaments which, by virtue of the inertia of the ligaments or droplets and the nozzle configuration and orientation, travel towards the roller 18 and hence the web without being unduly influenced by the electrode 34, see FIG. 7A.

Because the web is in motion, the ligaments (or droplets) effectively deposit on the web in discrete, generally parallel linear tracks extending in the direction of the web movement. By appropriate selection and control of the parameters referred to hereinbefore (e.g. interfacial properties, rate of deposition of the liquid per unit area, speed of travel of the substrate relative to the nozzle, viscosity of the liquid etc), the tracks can be deposited so that they wet out and merge transversely of the web and produce a substantially uniform coating.

The high voltage is applied to the nozzle 32 for a time interval which, taking into account the speed of travel of the web, results in the production of a panel of the desired dimension in the direction of web feed. This time interval is timed out by the signal generator 74 and at time $t_1$ the voltage applied to the nozzle is substantially instantaneously switched from high to low (e.g. from +20 kV to 0 kV). This results in the immediate cessation of ligament production by the nozzle (see FIG. 7B) and, because the liquid flow to the nozzle and hence the slot 50 is continuous, a slight build-up of liquid at slot 50 occurs. However, before the excess liquid can reach a level where it could detrimentally affect satisfactory spraying of the liquid, spraying operation of the nozzle is resumed; at time $t_2$ the signal generator 74 causes switch units 70 and 72 to apply a ligament generating electric field to the nozzle by coupling the nozzle and the auxiliary electrode to suitable voltages (e.g. 0 kV and −10 kV) such that the ligaments issuing from the nozzle are deflected away from the web and towards the auxiliary electrode 34 (see FIG. 7C).

The short interval of time between $t_1$ and $t_2$ is typically 6 msec or less and is employed as a safeguard against the possibility of indeterminate spraying during the switchover between the web spraying and the spray deflection modes of operation.

In the spray deflection mode, it will be understood that the liquid ligaments will be collected by the auxiliary electrode 34 thereby leaving a section of the web uncoated by that particular nozzle; however, that web section will normally be coated by another of the coating applicators either previously or subsequently during passage of the web over the roller 18. In this mode of operation, the liquid collecting on the auxiliary electrode is removed from the influence of the prevailing electric field so as to prevent the liquid being resprayed from the electrode 34 and causing contamination of the web or re-spraying towards the nozzle and disrupting the primary spray. In the embodiment of FIG. 2, removal of liquid is effected by drawing it through the inlet area 64 of the electrode 34 and into the interior of the receptacle 62, from which the liquid can be recycled back to the nozzle 32.

Figure 7A:
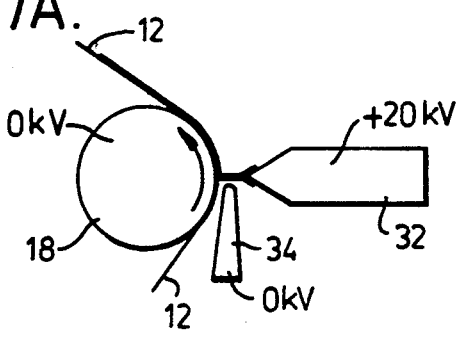
FIGS. 7A, 7B, 7C, 7D and 7E illustrate different stages in the spraying cycle of each coating applicator assembly.
Figure 7B:
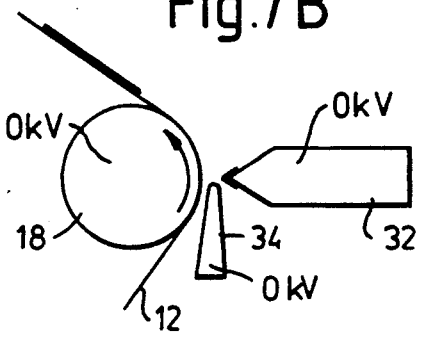
Figure 7C:
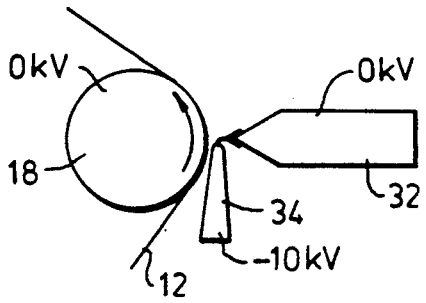
Figure 7D:
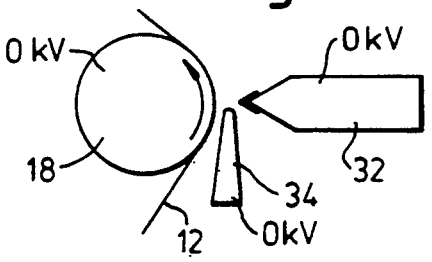
Figure 7E:
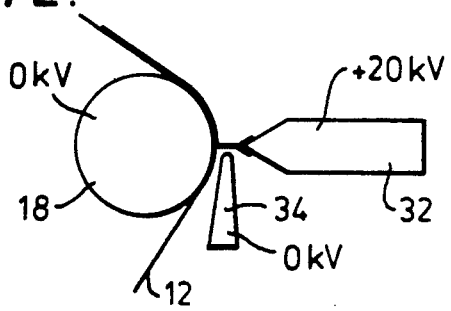

When the nozzle 32 is to resume operation in its coating mode, at time $t_3$, the signal generator 74 via switch units 70 and 72 first couples the auxiliary electrode 34 to a low voltage (e.g. 0 kV) and shortly thereafter, at time $t_4$, couples the nozzle 32 to a high voltage output of the HT generator (e.g. +20 kV) and the cycle is repeated Thus, during the time interval $t_3$–$t_4$, ligament production by the nozzle is temporarily terminated (see FIG. 7D) for the same reasons as referred to above in relation to time interval $t_1$–$t_2$. Thereafter normal web spraying is resumed (FIG. 7E).

Figure 8:
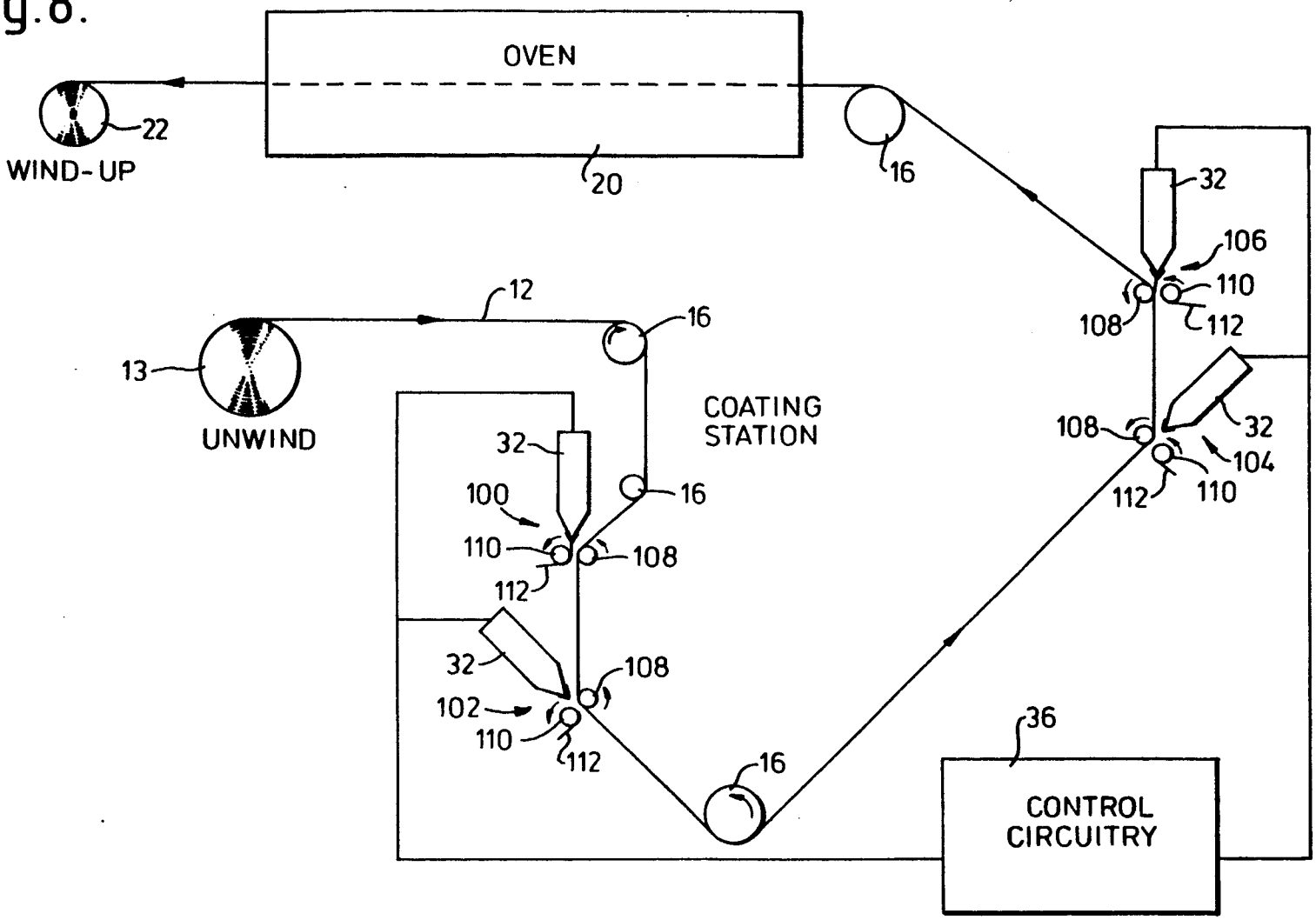
FIG. 8 is a diagrammatic view of a second embodiment of apparatus for coating a continuous web with panels of different coloured dyes to produce a dyesheet of the form shown in FIG. 1.

Referring now to FIG. 8, this shows an alternative and presently preferred embodiment. In FIG. 8 and related Figures, the same reference numerals are used to depict components similar to those described in relation to FIG. 2 and related Figures. In this case, the web 12 is fed continuously between storage and wind-up rollers 13, 22 via a coating station, guide rollers 16 and an oven 20. The coating station comprises four coating applicators 100–106 each applying a respective coating formulation to the web under the control of computer or micro- processor based control circuitry 36.

Each coating applicator comprises a nozzle 32 which may be constructed and arranged to operate in the same way as described with reference to FIG. 3. Associated with each nozzle 32 is a pair of driven rollers 108, 110 which may counter-rotate with respect to one another. The web 12 is entrained over the rollers 108 and, for reasons discussed in relation to the embodiment of FIG. 2, the arrangement is such that, after each traverse of the rollers 108, the direction of web travel has a significant component of vertical motion. The rollers 110 constitute auxiliary electrodes for effecting deflection of the sprayed ligaments during the non-coating mode of the respective nozzles 32.

To prevent respraying of liquid collecting on the rollers 110 during operation in the non-coating mode, each applicator is provided with means for removing the liquid from the influence of the electric field present in the vicinity of the respective applicator. In this embodiment, such means comprises the roller 110 in conjunction with a scraper or doctor blade 112. Because the rollers 110 are rotatably driven, liquid depositing on the surface proximate the nozzle is immediately transported away from that locality and then wiped or scraped off the roller 110 by the blade 112. The liquid removed by the blade 112 may be allowed to drain into a reservoir (not shown) from which it can be recycled back to the nozzle 32.

Although the nozzles 32 in the embodiment of FIG. 8 are illustrated as being oriented so that the nozzle axis extends along a plane midway between the rollers 108, 110, in practice it is desirable that the ligaments should impinge on the web at substantially right angles otherwise they tend to entrain air which can result in coatings with a bubbly texture. The roller 108 will tend to attract the ligaments radially in the direction of its axis but, if the nozzle is oriented as shown, there may still be a tendency for the ligaments to "wrap around" and entrain air. To reduce this tendency therefore, the nozzle may be arranged with its axis extending towards the roller 108 in order to promote projection of the ligaments/droplets along a trajectory generally radial to the roller 108 and hence perpendicular to the web.

Figure 9:
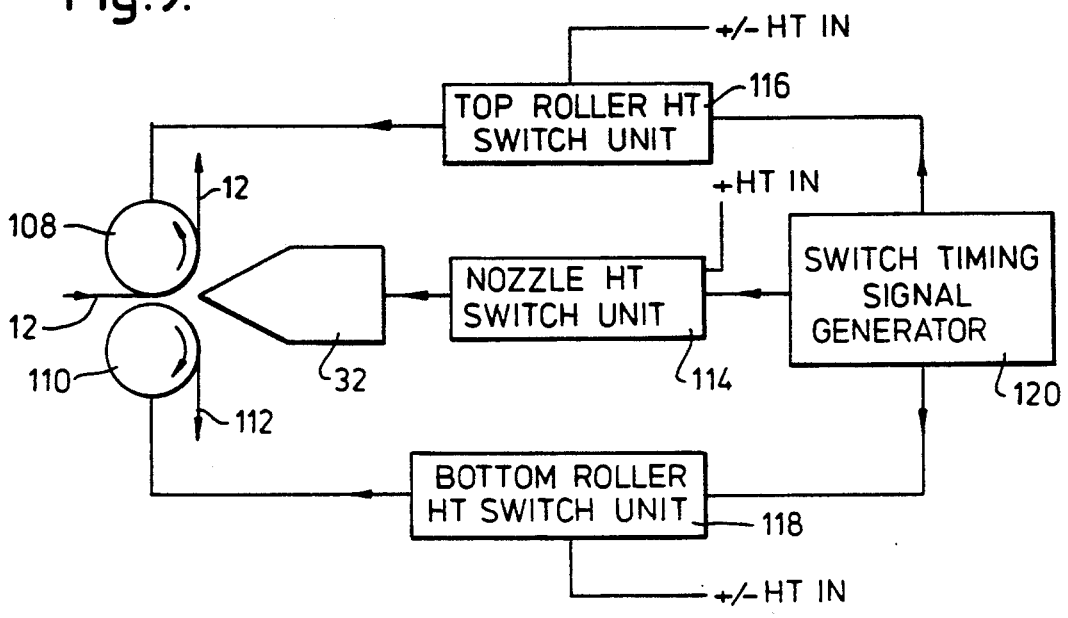
FIG. 9 is a view in block diagrammatic form the electrical circuitry for controlling the nozzles of the apparatus in FIG. 8.

That part of the control circuitry 36 relevant to each nozzle/auxiliary electrode assembly is shown in more detail in FIG. 9. The control circuitry 36 includes an HT generator from which various voltages can be derived, e.g. +20 kV, +3.5 kV and −3.5 kV. The application of these voltages to the nozzle and rollers 108 and 110 is controlled by respective switching units 114,116 and 118 which, in turn, are controlled by a switch timing signal generator 120. The timing signal generator 120 forms part of a microprocessor or computer which is programmed with data representing the particular format (e.g. panel dimensions and colour sequence) for the web to be coated and with data representing the positioning of the coating applicators 100–106 and web speed so that coating effected by the applicators is co-ordinated with the web speed and meets the format requirements for that particular web.

Figure 10:
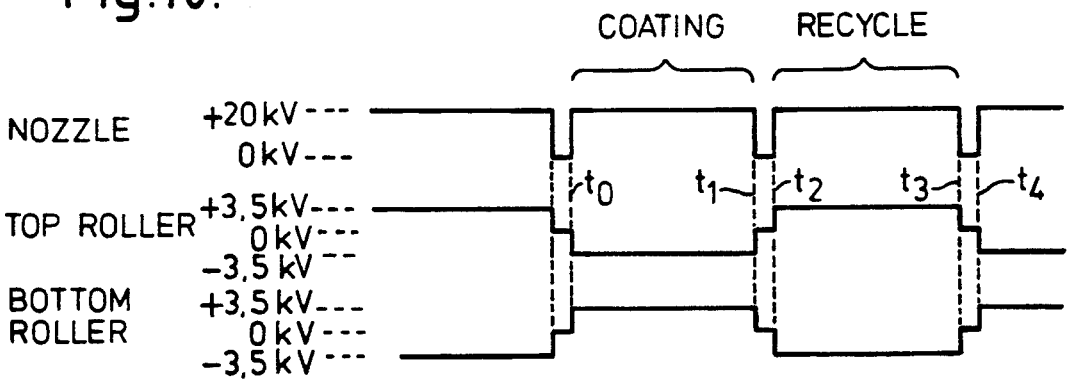
FIG. 10 is a timing diagram illustrating the sequence in which voltage changes are applied to each nozzle and associated rollers in the embodiment of FIG. 8.

The operating sequence of the circuitry shown in FIG. 9 is best understood by reference to the timing diagram of FIG. 10 and the diagrams of FIGS. 11A to 11E. For each coating applicator, each cycle may be considered to commence with the application of sufficient voltage to the nozzle 32 to produce ligament formation. This point in the cycle corresponds to the point $t_0$ in FIG. 10. At this time, a high voltage (e.g. +20 kV) is coupled to the nozzle 32 via the switch unit 114 under the control of the signal generator 120 while the rollers 108 and 110 are coupled to a low voltages of opposite polarity (e.g. −3.5 kV in the case of roller 108 and +3.5 kV in the case of roller 110—see FIG. 11A) via the respective switch units 116, 118 under the control of generator 120. The liquid, which is supplied to the nozzle continuously throughout the cycle, is caused to issue from the nozzle ledge 56 as ligaments which, by virtue of the nozzle configuration and orientation and voltages applied to the rollers, are attracted towards the roller 108.

Because the web is in motion, the ligaments (or droplets) effectively deposit on the web in discrete, generally parallel linear tracks extending in the direction of the web movement. By appropriate selection and control of the parameters referred to hereinbefore (e.g. interfacial properties, rate of deposition of the liquid per unit area, speed of travel of the substrate relative to the nozzle, viscosity of the liquid etc), the tracks can be deposited so that they wet out and merge transversely of the web and produce a substantially uniform coating.

The high voltage is applied to the nozzle 32 for a time interval which, taking into account the speed of travel of the web, results in the production of a panel of the desired dimension in the direction of web feed. This time interval is timed out by the signal generator 120 and at time $t_1$ the voltage applied to the nozzle is substantially instantaneously switched from high to low (e.g. from +20 kV to 0 kV). Simultaneously, the rollers 108 and 110 are connected to substantially the same potential as the nozzle (e.g. all three components may be connected to earth). This results in the immediate cessation of ligament production by the nozzle (see FIG. 11B) and, because the liquid flow to the nozzle and hence the slot 50 is continuous, a slight build-up of liquid at slot 50 occurs. However, before the excess liquid can reach a level where it could detrimentally affect satisfactory spraying of the liquid, spraying operation of the nozzle is resumed; at time $t_2$ the signal generator 120 causes switch units 114 and 118 to apply a ligament generating electric field to the nozzle by coupling the nozzle and the auxiliary electrode to suitable voltages (e.g. 20 kV and −3.5 kV) while coupling the roller 108 to a voltage which is lower than that applied to the nozzle. In this way, the ligaments issuing from the nozzle are deflected away from the web and towards the roller 110 (see FIG. 11C).

The short interval of time between $t_1$ and $t_2$ is typically 6 msec or less and is employed as a safeguard against the possibility of indeterminate spraying during the switchover between the web spraying and the spray deflection modes of operation.

In the spray deflection mode, it will be understood that the liquid ligaments will be collected by the roller 110 thereby leaving a section of the web uncoated by that particular nozzle; however, that web section will normally be coated by another of the coating applicators either previously or subsequently during passage of the web through the coating station. In this mode of operation, the liquid collecting on the roller 110 is removed from the influence of the prevailing electric field in the manner described above so as to prevent the liquid being resprayed from the roller 110 and causing contamination of the web.

Figure 11A:
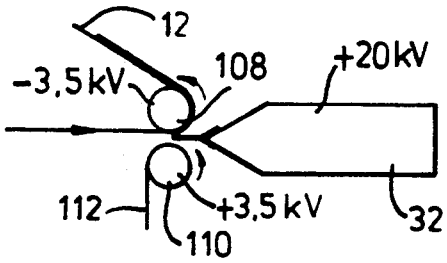
FIGS. 11A, 11B, 11C, 11D and 11E illustrate different stages in the spraying cycles of each coating applicator assembly.
Figure 11B:
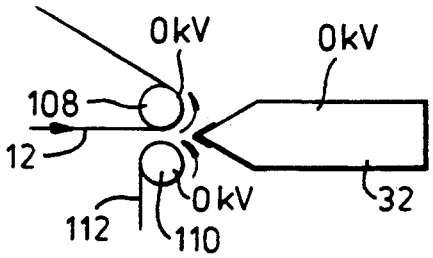
Figure 11C:
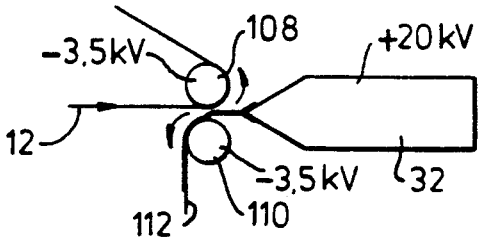
Figure 11D:
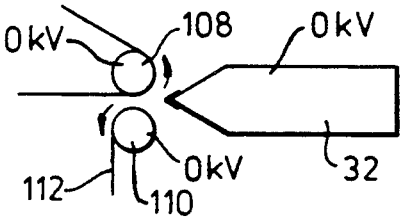
Figure 11E:
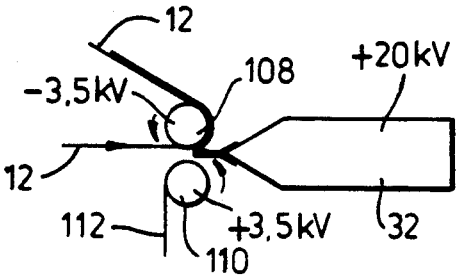

When the nozzle 32 is to resume operation in its coating mode, at time $t_3$, the signal generator 120 via switch units 114–118 first couples the nozzle 32 and the rollers 108 and 110 to a common source of potential (e.g. earth potential)—see FIG. 11D—and shortly thereafter, at time $t_4$. couples the nozzle 32 to a high voltage output of the HT generator (e.g. +20 kV) and the rollers 108, 110 to lower, opposite polarity voltages (e.g. −3.5 kV and +3.5 kV respectively); the cycle is then repeated. Thus, during the time interval $t_3$–$t_4$, ligament production by the nozzle is temporarily terminated (see FIG. 11D) for the same reasons as referred to above in relation to time interval $t_1$–$t_2$. Thereafter normal web spraying is resumed (FIG. 11E).

Figure 1A:
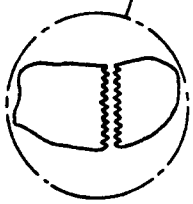

From the embodiments described above, it will be seen that the coating is applied to the web by the deposition of a multitude of individually formed ligaments (which deposit as such or as droplets) to form a series of substantially parallel tracks which, initially, may be spaced apart in the widthwise direction of the web but spread and merge to form a substantially uniform coating. In the case of deposition as droplets, the spreading and merging may also occur lengthwise of the web as well as widthwise. In practice, we have observed that at the leading and trailing edges of the deposited areas of panels, the fact that the coating has been deposited in this manner is evidenced by the presence of a zigzag profile to those edges. This is illustrated in FIG. 1A. The zigzag profile, while usually visibly discernible, in general has a peak to trough height which is sufficiently small that it has no detrimental affect on the dyesheet end-product.

In the embodiments described above, it will be seen that format changes in the pattern of colour panels can be readily modified by altering the timing of the spray deposition and spray deflection modes of operation of each of the nozzles. Thus, the control circuitry may include user-input means to enable a particular format to be selected.

Although it is preferred to deposit the ligaments/droplets forming each panel of a particular colour by means of a single nozzle and controlling parameters such as web speed, viscosity, etc. so that the ligaments/droplets merge to form a substantially uniform coating, there may be circumstances where this is not possible, e.g. the liquid may not "wet out" sufficiently on the substrate to enable adjacent ligaments (or droplets derived from adjacent ligaments) to merge with one another and produce a substantially uniform thickness coating. In this event, it is contemplated that each coating formulation may be applied by a group of nozzles, i.e. so that each panel is produced by, for example, a pair of banked nozzles, the related nozzles being arranged so that each group of nozzles deposit the formulation on to the same panels or areas of the substrate, the areas produced by one group being interleaved with those produced by the other groups. The ligaments generated by the nozzles in each group may be deposited in interleaved generally parallel tracks extending lengthwise of the substrate, which tracks then merge with each other. The nozzles forming each group may be spaced apart in the direction of travel of the substrate, the nozzles being controlled in such a way that they spray onto the same areas of the substrate but at different times.

For example, the embodiment illustrated in FIG. 2 may be adapted in such a way that the applicator assemblies are arranged in two groups, i.e. one group comprising assemblies 24 and 26 controlled so as to apply one colour to the same substrate areas, and a second group comprising assemblies 28 and 30 controlled so as to apply a different colour to the common substrate areas which are offset from those coated by assemblies 24, 26. When so modified, the embodiment of FIG. 2 can coat two colours but it will be appreciated that additional colours may be coated by the inclusion of further pairs of applicator assemblies, similar to assemblies 24, 26 and 28, 30, at suitable locations along the path of travel of the web.

It will be understood from the foregoing that the ligaments/droplets forming each panel of a particular colour may be deposited by, for example, a pair of nozzles which may be arranged to deposit ligaments/droplets in an interleaved manner and thereby produce a substantially uniform thickness coating, i.e. each nozzle may produce ligament/droplet tracks in the gaps between the tracks produced by the other nozzle.

Where it is desired that the related nozzles should deposit the ligaments/droplets in an interleaved fashion, it is preferred that nozzles of the toothed variety (as disclosed in our prior European Patent No. 243031) are used since nozzles of this type provide well-defined sites for ligament formation and, by appropriate staggering of the nozzles, it can be arranged that the tracks produced by the related nozzles teeth are interleaved and fill the gaps left by the other nozzle or nozzles of the same group.

We do not however exclude the possibility of two or more nozzles being used to deposit each colour panel by way of two or more layers without taking special steps to interleave the deposited ligaments or droplet streams. For instance, the ligaments/droplets deposited by each group of nozzles may overlap at least to some extent yet afford deposition of sufficient liquid for the liquid to spread and merge to form a substantially uniform coating.

Where two or more nozzles are used to lay the same colour on the same sections of web, the nozzles may be spaced apart in the direction of web feed and each may have auxiliary target means associated with it. It is envisaged that such paired nozzles would be sited in such a way that minimal or substantially no evaporation of solvent occurs between laydown of coating by the related upstream and downstream nozzles.

In some cases, it may be desired to produce special markings on the substrate, for example registration markings which require to be interleaved with the colour panels but need not be the full width of the substrate. In this instance, it will be appreciated that the coating station may include nozzles arranged and controlled by control circuitry, to produce reduced width markings at the appropriate positions along the substrate web.

Although in the illustrated embodiments, the colour panels are laid down by electrostatic coating, it is within the ambit of the invention to use electrostatic coating in conjunction with other coating techniques. For example, panels of one or more colours may be laid down using electrostatic coating as described herein whilst the remaining panel colour or colours may be laid down, either in the same pass or in separate passes, using a different technique such as gravure roller coating. Thus, the invention includes within its scope conventional coating equipment, such as gravure roller coating equipment, retro-fitted with one or more nozzles constructed and arranged to operate as described herein with the aim of affording greater flexibility than is attainable by the conventional equipment, e.g. extending the number of colours that can be laid down using the conventional equipment.

In another modification, the different colour panels may be applied during different passes of the substrate through the coating station. In this instance, the coating station may comprise for example a single nozzle (and associated auxiliary electrode, etc.) arranged to coat one colour per pass of the web through the coating station, photo-electric or other means being provided to ensure registration when further colours are deposited on the web during subsequent passes of the web through the coating station.

Where coating of the substrate is effected by using groups of nozzles to spray given sections of the substrate, the nozzles of each group may be supplied with different coating formulations for example to effect multi-layer coats. Also, the nozzles may be used to apply different liquid formulations to the same sections of the substrate such that the formulations react chemically; for instance, the formulations applied to a common section of substrate by different nozzles may constitute separate components of a cross-linking system whereby the components interact to produce a cured and cross-linked coating, e.g. a coating having scratch-resistant properties.

EXAMPLE 1

In a prototype design based on the apparatus of FIGS. 8 and 9, the rollers 108 and 110 were of the same diameter (15 mm) and the perpendicular spacing between their peripheries was 4 mm. The nozzle 32 was oriented with the ledge 58 thereof lying in a plane generally coplanar with the top of the peripheral surface of the roller 110 and with the extremity of the ledge 58 spaced 10.5 mm from a plane containing the axes of the rollers. The nozzle was oriented with its axis extending at an angle of 60° relative to the latter plane and directed towards the roller 108. The two parts 38 and 40 of the nozzle were composed of "Tufnol" Kite brand (Registered Trade Mark) with extensive hard finishing, and the gasket 41 was composed of polyester sheet material having a thickness of 190 microns. The legs 43 of the gasket were shaped as described with reference to FIG. 3 so as to avoid any "dead spots" and thereby ensure generation of ligaments having substantially the same liquid flow rate.

The legs 43 were spaced apart with a pitch of 25 mm, and terminated 7 mm short of the nozzle outlet, each leg 43 having an overall length of 36.8 mm and terminating in a tapering section extending for 16.8 mm and having an included angle of 11°. At the widest section thereof, each leg 43 had a width of 4 mm. The body parts were secured together with brass nut and bolt fasteners and the HT electrode comprised a track of silver solder.

A web speed of 8 meters/min was used and the voltages applied to the nozzle and the rollers were as described with reference to FIGS. 8 to 11. The web comprised a polyester of 23 microns thickness. The coating formulation used was such as to give a coat weight of 1 $g/m^{-2}$ and consisted of an approximately 5% solids solution of polymer and dye in a mixture of THF and toluene. With this arrangement, satisfactory substantially uniform thickness coating of the web was achieved with sharp cut-off.

EXAMPLE 2

In order to assess the uniformity of the coating thickness obtained using the method described herein, samples of a 6 micron base film having a sub-coat on one side and a backcoat on the opposite side were coated with the same formulations by the method described herein and by conventional gravure printing, i.e. in each case base film of the same thickness and origin was used and the base film was sub-coated by exactly the same process for all samples. The sub-coat and backcoat are conventionally used in thermal transfer dye sheets in order to ensure the performance of the product.

Uniformity of coating thickness was evaluated in terms of the Mean Roughness of the surface $R_a$, as defined by Perthen and measured using a Mahr Perthen Perthometer MDLS6P instrument. The formulations were in each case coated on the sub-coated side of the base film. The electrostatic coating was carried out using a single nozzle, of the design type described with reference to FIG. 3 and Example I above, the nozzle being arranged with its axis disposed radially relative to a earthed stainless steel roller over which the base film was entrained, the nozzle azis being inclined upwardly at 30° to the horizontal with the nozzle outlet spaced about 4.5 mm from the surface of the roller such that the ligaments contacted the base film at a location where there was full contact between the film and the roller surface.

Formulation 1

Composition: 5.1% by weight total solids 94.9% THF by weight and toluene in the ratio 80:20
Solution resistivity: ca 8 Mohm m
Solution viscosity: ca 10.5 centipoise
Solution density: 0.892 g/cc The solids components comprised 0.9% CI Solvent Yellow 141 (supplied by ICI as Dispersol Yellow B6G), 1.36% CI Disperse Yellow 126 (supplied by ICI as Dispersol Yellow D7G), 2.27% polyvinylbutyral (PVB, grade BX1 supplied by Hercules) and 0.57% ethyl cellulose (EC, grade T10 supplied by Sekisui)

This formulation was coated electrostatically using a web speed of 12 m/min, a solution delivery rate of 16 cc $m^{-2}$ (which corresponds to a dry coat thickness of about 1 micron) and a nozzle voltage of the order of 13.5 to 15.8 kV resulting in deposition of the ligaments as such with a ligament density of 12.7 ligaments per cm. The formulation was also coated onto an identical section of web using a conventional gravure printing technique. The resulting coatings could be readily distinguished from one another in that the cell pattern of the gravure roller could be visibly discerned in the gravure printed coated sample. Using Perthometer measurements, the average value for $R_a$ (taken from 5 samples produced by each method) was found to be 0.184 for the electrostatically produced coatings compared with 0.354 for the gravure printed coatings thus indicating that the electrostatic coating method is capable of producing uniform coating thicknesses comparable, if not better than, the gravure printing method.

Formulation 2

Composition: 3.85% by weight total solids 96.15% by weight THF and toluene in the ratio 80:20
Solution resistivity: ca 5.64 Mohm m
Solution viscosity: ca 10 centipoise
Solution density: ca 0.89 g/cc The solids components comprised 0.8% dye having the formula I below, 0.8% CI Solvent Blue 63 (supplied by ICI as Organosol Bright Blue IN), 1.13% ethyl cellulose (EC, grade T200 supplied by Sekisui) and 1.13% ethyl cellulose (EC grade T10 supplied by Sekisui)

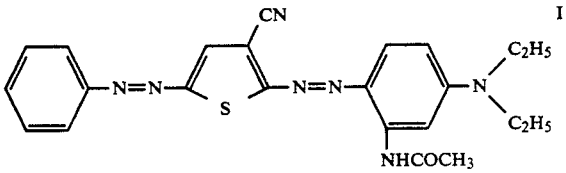

I

This formulation was coated electrostatically using a web speed of 12 m/min, a solution delivery rate of 16 ccm., and a nozzle voltage of 12.5 kV resulting in deposition of the ligaments as such with a ligament density of 12.0 ligaments per cm. The formulation was also coated onto an identical section of web using a conventional gravure printing technique. Again the resulting coatings could be readily distinguished from one another in that the cell pattern of the gravure roller could be visibly discerned in the gravure printed coated sample. Using Perthometer measurements, the average value for $R_a$ (taken from 5 samples produced by each method) was found to be 0.304 for the electrostatically produced coatings compared with 0.283 for the gravure printed coatings thus indicating that the electrostatic coating method is capable of producing uniform coating thicknesses comparable with the gravure printing method.

Formulation 3

Composition: 5.64% by weight total solids 94.36% by weight THF and toluene in the ratio 80:20
Solution resistivity: ca 13.4 Mohm m
Solution viscosity: ca 11 centipoise
Solution density: ca 0.897 g/cc The solids components comprised 2.15% CI Disperse Red 60 (supplied by ICI as Dispersol Red B-2B), 0.53% dye having the structural formula II below, 2.37% polyvinylbutyral (PVB, grade BX-1 supplied by Hercules) and 0.59% ethyl cellulose (EC, grade T10 supplied by Sekisui).

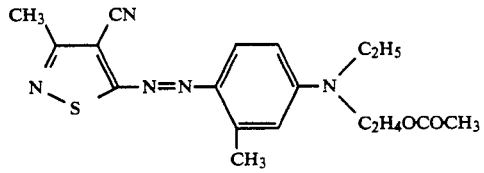

II

This formulation was coated electrostatically using a web speed of 12 m/min, a solution delivery rate of 16 cc $m^{-2}$ and a nozzle voltage of 16.4 kV resulting in deposition of the ligaments as such with a ligament density of 22 ligaments per cm. The formulation was also coated onto an identical section of web using a conventional gravure printing technique. Again the resulting coatings could be readily distinguished from one another in that the cell pattern of the gravure roller could be visibly discerned in the gravure printed coated sample. Using Perthometer measurements, the average value for $R_a$ (taken from 5 samples produced by each method) was found to be 0.296 for the electrostatically produced coatings compared with 0.318 for the gravure printed coatings thus indicating that the electrostatic coating method is capable of producing uniform coating thicknesses comparable with the gravure printing method.

From the above results, it will be seen that coatings can be produced which are comparable with those produced by conventional gravure printing. In contrast with gravure printing however, the electrostatic method of the invention affords much greater flexibility in terms of the ease with which colour changes and format changes can be made.

We claim:

1. A method of coating a substrate, comprising: supplying an extended nozzle with liquid to form a continuous film of liquid lengthwise of the extended nozzle;

moving the substrate and the nozzle relative to one another in a direction other than parallel to the direction of nozzle extension;

generating from the nozzle, by means of the application of a high electrical potential, a plurality of generally parallel ligaments of liquid which are simultaneously drawn out from the nozzle by preponderantly electrostatic forces; and directing the ligaments towards the substrate so that the ligaments deposit on the substrate as generally parallel ligaments and/or in the form of generally parallel streams of droplets (derived from breaking up of the ligaments) and thereafter merge to form a coating on the substrate surface.

2. A method of coating a substrate, comprising:

supplying an extended nozzle with liquid to form a continuous film of liquid lengthwise of the extended nozzle;

moving the substrate and the nozzle relative to one another in a direction other than parallel to the direction of nozzle extension;

generating from the nozzle, by means of the application of a high electrical potential, a plurality of generally parallel ligaments of liquid which are simultaneously drawn out from the nozzle by preponderantly electrostatic forces; and directing the ligaments towards the substrate so that the ligaments deposit on the substrate as generally parallel ligaments and/or in the form of generally parallel streams of droplets (derived from breaking up of the ligaments) and thereafter merge to form a coating on the substrate surface;

wherein deposition of the ligaments and/or droplets on the substrate is interrupted periodically to produce a series of coated sections on the substrate which are spaced apart in the direction of movement of the substrate and the nozzle relative to one another.

3. A method as claimed in claim 2 in which the deposition of the ligaments on the substrate is periodically interrupted without interrupting supply of liquid to the nozzle.

4. A method as claimed in claim 1 in which the generation of the ligaments is such that the liquid flow rate associated with each ligament is substantially the same for substantially all of the ligaments.

5. A method as claimed in claim 1 in which the substrate is fed along a feed path which traverses a number of spraying stations at each of which is passes a nozzle and conductor arrangement as claimed hereinabove.

6. A method as claimed in claim 1 in which a plurality of said nozzles are provided, each being arranged to deposit said ligaments or streams of droplets generated thereby on to the substrate.

7. A method as claimed in claim 6 in which the nozzles are arranged to deposit liquid on to different sections of the substrate.

8. A method as claimed in claim 6 in which at least some of the nozzles are arranged to deposit liquid on to the same sections of the substrate.

9. A method as claimed in claim 8 in which the nozzles which deposit liquid on to the same section of the substrate are arranged so that the ligaments/droplets deposited by one nozzle are interleaved with those deposited by the other nozzle or nozzles.

10. A method of coating a substrate, comprising:

supplying an extended nozzle with liquid to form a continuous film of liquid lengthwise of the extended nozzle;

moving the substrate and the nozzle relative to one another in a direction other than parallel to the direction of nozzle extension;

generating from the nozzle, by means of the application of a high electrical potential, a plurality of generally parallel ligaments of liquid which are simultaneously drawn out from the nozzle by preponderantly electrostatic forces;

directing the ligaments towards the substrate so that the ligaments deposit on the substrate as such and/or in droplet form; and periodically interrupting deposition of the ligaments and/or droplets on the substrate by electrostatically deflecting the ligaments in a direction away from the substrate.

11. A method as claimed in claim 10 in which the ligaments deposit on the substrate in discrete zones as generally parallel ligaments and/or in the form of generally parallel streams of droplets (derived from breaking up of the ligaments) and thereafter merge to form a coating on the substrate surface; deposition of said ligaments/droplets on to the substrate is interrupted by deflecting the ligaments away from the substrate and towards an auxiliary target means; coating of the substrate with liquid from the nozzle is subsequently resumed; and liquid accumulating on the auxiliary target means is removed while continuing generation of said liquid ligaments from the nozzle.

12. A method as claimed in claim 10 in which the substrate is fed along a feed path which traverses a number of spraying stations at each of which it passes a nozzle and conductor arrangement as claimed hereinabove.

13. A method as claimed in claim 10 in which a plurality of said nozzles are provided, each being arranged to deposit said ligaments or streams of droplets generated thereby on to the substrate.

14. A method as claimed in claim 13 in which the nozzles are arranged to deposit liquid on to different sections of the substrate.

15. A method as claimed in claim 13 in which a plurality of different liquid formulations are provided and each formulation is deposited by a respective nozzle.

16. A method as claimed in claim 13 in which at least some of the nozzles are arranged to deposit liquid on to the same sections of the substrate.

17. A method as claimed in claim 16 in which those nozzles which deposit liquid on to the same section of the substrate are arranged so that the ligaments/droplets deposited by one nozzle are interleaved with those deposited by the other nozzle or nozzles.

18. Apparatus for coating a substrate, said apparatus comprising:

an extended nozzle;

means for supplying liquid to the nozzle so that, in use, a continuous film of liquid is formed lengthwise of the extended nozzle;

means for effecting relative movement between the nozzle and a substrate to be coated in a direction which is other than parallel to the direction of nozzle extension;

high voltage circuit means for simultaneously drawing out, by preponderantly electrostatic forces, a plurality of generally parallel ligaments of liquid from said continuous liquid film; and means locating the nozzle relative to the substrate in such a way that the ligaments deposit on the substrate as generally parallel ligaments and/or in the form of generally parallel streams of droplets (derived from breaking up of the ligaments) and thereafter merge to form a coating on the substrate surface.

19. Apparatus as claimed in claim 18 including means for securing generation of the ligaments in such a way that the liquid flow rate associated with each ligament is substantially the same for substantially all of the ligaments.

20. Apparatus for coating a substrate, said apparatus comprising:

an extended nozzle;

means for supplying liquid to the nozzle so that, in use, a continuous film of liquid is formed lengthwise of the extended nozzle;

means for effecting relative movement between the nozzle and a substrate to be coated in a direction which is other than parallel to the direction of nozzle extension;

high voltage circuit means for simultaneously drawing out, by preponderantly electrostatic forces, a plurality of generally parallel ligaments of liquid from said continuous liquid film;

means for locating the nozzle relative to the substrate in such a way that the ligaments deposit on the substrate as generally parallel ligaments and/or in the form of generally parallel streams of droplets (derived from breaking up of the ligaments) and thereafter merge to form a coating on the substrate surface; and means for periodically interrupting deposition of said ligaments and/or droplets on the substrate to produce a series of coated sections on the substrate which are spaced apart in the direction of relative movement.

21. Apparatus for coating a substrate, said apparatus comprising:

an extended nozzle;

means for supplying liquid to the nozzle so that, in use, a continuous film of liquid is formed lengthwise of the extended nozzle;

means for effecting relative movement between the nozzle and a substrate to be coated in a direction which is other than parallel to the direction of nozzle extension;

high voltage circuit means for simultaneously drawing out, by preponderantly electrostatic forces, a plurality of generally parallel ligaments of liquid from said continuous liquid film;

means for locating the nozzle relative to the substrate in such a way that the ligaments deposit on the substrate as generally parallel ligaments and/or in the form of generally parallel streams of droplets (derived from breaking up of the ligaments) and thereafter merge to form a coating on the substrate surface; and means for periodically interrupting deposition of the ligaments on the substrate and in which said liquid supply means supplies the liquid to the nozzle continuously.

22. Apparatus as claimed in claimed in claim 20 or claim 21 including means for securing generation of the ligaments in such a way that the liquid flow rate associated with each ligament is substantially the same for substantially all of the ligaments.

23. Apparatus for coating a substrate, said apparatus comprising:

an extended nozzle;

means for supplying liquid to the nozzle so that, in use, a continuous film of liquid is formed lengthwise of the extended nozzle;

means for effecting relative movement between the nozzle and a substrate to be coated in a direction which is other than parallel to the direction of nozzle extension;

high voltage circuit means for simultaneously drawing out by preponderantly electrostatic forces a plurality of generally parallel ligaments of liquid from said continuous liquid film;

means locating the nozzle relative to the substrate in such a way that the ligaments deposit on the substrate as such and/or in droplet form; and means for periodically interrupting deposition of said ligaments and/or droplets on the substrate by electrostatically deflecting the ligaments and/or droplets in a direction away from the substrate.

24. Apparatus as claimed in claim 23 further comprising auxiliary target means; means operable periodically to deflect the ligaments away from the substrate and towards the auxiliary target means and thereby interrupt deposition of said ligaments/droplets on to the substrate; and means for removing liquid accumulating on the auxiliary target means while continuing generation of said liquid ligaments from the nozzle.

25. Apparatus as claimed in claim 24 including means for recycling at least part of the liquid removed from the auxiliary target means to the nozzle.

26. Apparatus as claimed in claim 23 in which a plurality of said nozzles are provided, each being arranged to deposit said ligaments or streams of droplets generated thereby on to different sections of the substrate.

27. Apparatus as claimed in claim 26 in which a plurality of different liquid formulations are provided and each formulation is deposited by a respective nozzle.

28. Apparatus as claimed in claim 23 including a plurality of nozzles at least some of which are arranged to deposit liquid on to the same sections of the substrate.

29. Apparatus as claimed in claim 28 in which those nozzles which deposit liquid on to the same section of the substrate are arranged so that the ligaments/droplets deposited by one nozzle are interleaved with those deposited by the other nozzle or nozzles.

30. A method of coating a substrate, comprising:

supplying an extended nozzle with liquid to form a continuous film of liquid lengthwise of the extended nozzle;

moving the substrate and the nozzle relative to one another in a direction other than parallel to the direction of nozzle extension;

generating from the nozzle, by means of the application of a high electrical potential, a plurality of generally parallel ligaments of liquid which are simultaneously drawn out from the nozzle by preponderantly electrostatic forces; and directing the ligaments towards the substrate so that the ligaments deposit on the substrate as generally parallel ligaments and/or in the form of generally parallel streams of droplets (derived from breaking up of the ligaments) and thereafter merge to form a coating on the substrate surface;

wherein deposition of the ligaments on the substrate is periodically interrupted without interrupting supply of liquid to the nozzle.

31. A method as claimed in claims 2, 3, or 25 in which the generation of the ligaments is such that the liquid flow rate associated with each ligament is substantially the same for substantially all of the ligaments.

32. A method of coating a substrate, comprising:

supplying an extended nozzle with liquid to form a continuous film of liquid lengthwise of the extended nozzle;

moving the substrate and the nozzle relative to one another in a direction other than parallel to the direction of nozzle extension;

generating from the nozzle, by means of the application of a high electrical potential, a plurality of generally parallel ligaments of liquid which are simultaneously drawn out from the nozzle by preponderantly electrostatic forces; and directing the ligaments towards the substrate so that the ligaments deposit on the substrate as generally parallel ligaments and/or in the form of generally parallel streams of droplets (derived from breaking up of the ligaments) and thereafter merge to form a coating on the substrate surface;

wherein a plurality of said nozzles are provided, each being arranged to deposit said ligaments or streams of droplets generated thereby on to the substrate; and wherein a plurality of different liquid formulations are provided and each formulation is deposited by a respective nozzle.

* * * * *